US010991295B2

(12) United States Patent
Takizawa et al.

(10) Patent No.: US 10,991,295 B2
(45) Date of Patent: Apr. 27, 2021

(54) DISPLAY DRIVER, ELECTRO-OPTICAL DEVICE, ELECTRONIC APPARATUS, AND MOBILE BODY

(71) Applicant: Seiko Epson Corporation, Tokyo (JP)

(72) Inventors: Ryota Takizawa, Chino (JP); Norichika Muraki, Hara-Mura (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/919,165

(22) Filed: Jul. 2, 2020

(65) Prior Publication Data

US 2021/0005157 A1 Jan. 7, 2021

(30) Foreign Application Priority Data

Jul. 5, 2019 (JP) ..... JP2019-125793

(51) Int. Cl.
*G09G 3/20* (2006.01)
*G09G 3/36* (2006.01)

(52) U.S. Cl.
CPC ..... *G09G 3/2018* (2013.01); *G09G 3/3622* (2013.01); *G09G 3/3614* (2013.01); *G09G 2300/0478* (2013.01); *G09G 2320/0276* (2013.01); *G09G 2320/041* (2013.01); *G09G 2340/0435* (2013.01)

(58) Field of Classification Search
CPC ..... G09G 3/04–19; G09G 3/2018–204; G09G 3/36–3696; G09G 2300/0478; G09G 2340/0435; G09G 2320/041; G09G 2320/0276; G09F 9/00–46
See application file for complete search history.

(56) References Cited

U.S. PATENT DOCUMENTS 5,206,635 A * 4/1993 Inuzuka ..... G09G 3/3611 345/99
5,608,422 A * 3/1997 Ikeda ..... G09G 3/36 345/101
5,854,879 A * 12/1998 Inuzuka ..... G09G 3/3611 345/89

(Continued)

FOREIGN PATENT DOCUMENTS

JP 2006-243560 A 9/2006
JP 2013-057905 A 3/2013

(Continued)

*Primary Examiner* — Gene W Lee
(74) *Attorney, Agent, or Firm* — Harness, Dickey & Pierce, P.L.C.

(57) ABSTRACT

A display driver (100) drives a liquid crystal panel (200) that is driven by a static drive method. The display driver (100) includes an interface circuit (110), a selection circuit (120), and a drive circuit (130). The interface circuit (110) receives instruction information and display data from the outside. The selection circuit (120) selects n pieces of selected duty ratio data, which are n pieces of duty ratio data of k pieces of duty ratio data, based on the instruction information. The drive circuit (130) selects output duty ratio data corresponding to a tone value indicated by the display data from the n pieces of selected duty ratio data, and performs PWM driving of the liquid crystal panel (200) by outputting a drive signal having a duty ratio indicated by the selected output duty ratio data.

11 Claims, 11 Drawing Sheets

TABLE

| MODEL NUMBER | TONE VALUE | DUTY RATIO DATA |
|---|---|---|
| 00 | 0000 | D0 |
| | 0001 | D10 |
| | 0010 | D17 |
| | 0011 | D25 |
| | 0100 | D30 |
| | 0101 | D32 |
| | 0110 | D34 |
| | 0111 | D36 |
| | ... | ... |
| | 1111 | D74 |
| 01 | 0000 | D0 |
| | 0001 | D22 |
| | 0010 | D28 |
| | 0011 | D30 |
| | 0100 | D32 |
| | 0101 | D34 |
| | 0110 | D35 |
| | 0111 | D36 |
| | ... | ... |
| | 1111 | D74 |

(56) References Cited

U.S. PATENT DOCUMENTS

| | | | | | |
|---|---|---|---|---|---|
| 5,912,712 | A * | 6/1999 | Doherty | G09G 3/2018 | 348/471 |
| 6,803,899 | B1 * | 10/2004 | Masazumi | G09G 3/3629 | 345/101 |
| 6,980,193 | B2 * | 12/2005 | Hoshino | G09G 3/3622 | 345/691 |
| 8,456,414 | B2 * | 6/2013 | Lin | G09G 3/344 | 345/107 |
| 10,847,077 | B2 * | 11/2020 | Sakariya | G09G 3/32 | |
| 2003/0085861 | A1 * | 5/2003 | Hoshino | G09G 3/3622 | 345/89 |
| 2006/0197729 | A1 | 9/2006 | Shiraishi et al. | | |
| 2011/0157130 | A1 * | 6/2011 | Yasue | G09G 3/2077 | 345/211 |
| 2019/0244572 | A1 * | 8/2019 | Le | G09G 3/36 | |

FOREIGN PATENT DOCUMENTS

| | | | | |
|---|---|---|---|---|
| JP | 2019-045766 | A | 3/2019 | |
| WO | WO-2006044625 | A2 * | 4/2006 | B60Q 1/34 |
| WO | 2019-049670 | A1 | 3/2019 | |

* cited by examiner

INSTRUCTION INFORMATION

| TONE VALUE | DUTY RATIO DATA |
|---|---|
| 0000 | D0 |
| 0001 | D10 |
| 0010 | D17 |
| 0011 | D25 |
| 0100 | D30 |
| 0101 | D32 |
| 0110 | D34 |
| 0111 | D36 |
| ... | ... |
| 1111 | D74 |

FIG. 11

INSTRUCTION INFORMATION

| LIQUID CRYSTAL PANEL MODEL | MODEL NUMBER |
|---|---|
| A | 00 |
| B | 01 |

FIG. 12

TABLE

| MODEL NUMBER | TONE VALUE | DUTY RATIO DATA |
|---|---|---|
| 00 | 0000 | D0 |
| | 0001 | D10 |
| | 0010 | D17 |
| | 0011 | D25 |
| | 0100 | D30 |
| | 0101 | D32 |
| | 0110 | D34 |
| | 0111 | D36 |
| | ... | ... |
| | 1111 | D74 |
| 01 | 0000 | D0 |
| | 0001 | D22 |
| | 0010 | D28 |
| | 0011 | D30 |
| | 0100 | D32 |
| | 0101 | D34 |
| | 0110 | D35 |
| | 0111 | D36 |
| | ... | ... |
| | 1111 | D74 |

FIG. 13

| TEMPERATURE | FRAME FREQUENCY |
|---|---|
| T1 | f1 |
| T2 | f2 |
| T3 | f3 |
| T4 | f4 |
| ... | ... |
| T16 | f16 |

FIG. 14

DISPLAY DRIVER, ELECTRO-OPTICAL DEVICE, ELECTRONIC APPARATUS, AND MOBILE BODY

The present application is based on, and claims priority from JP Application Serial Number 2019-125793, filed Jul. 5, 2019, the disclosure of which is hereby incorporated by reference herein in its entirety.

BACKGROUND

1. Technical Field

The present invention relates to a display driver, an electro-optical device, an electronic apparatus, a mobile body, and the like.

2. Related Art

A PWM tone method is known as a method of driving a liquid crystal panel. In this driving method, a display driver drives a liquid crystal panel by outputting a PWM drive signal having a duty ratio corresponding to the tone value of display data.

A known technique of the PWM tone method is disclosed in JP-A-2006-243560, for example. A liquid crystal driver that drives a liquid crystal panel using a PWM drive signal having a duty ratio that is set in accordance with the VT characteristic of liquid crystal is disclosed in JP-A-2006-243560. The VT characteristic is a characteristic indicating the relationship between a voltage applied to liquid crystal and transmittance of the liquid crystal. In the technique disclosed in JP-A-2006-243560, the PWM drive signal is set in accordance with a specific liquid crystal panel to be driven by the liquid crystal driver. That is, the PWM drive signal is generated in accordance with a specific VT characteristic, in the technique disclosed in JP-A-2006-243560.

The VT characteristic of liquid crystal changes depending on the type of the liquid crystal. That is, in a plurality of types of liquid crystal panels that have adopted types of liquid crystal that differ to each other, the VT characteristics of the types of liquid crystal differ to each other. Therefore, there is a problem in that, even if waveforms of the PWM drive signal suitable for one liquid crystal panel are set, these waveforms are not suitable for the other liquid crystal panels.

SUMMARY

One aspect of the disclosure relates to a display driver that drives a liquid crystal panel that is driven by a static drive method. The display driver includes: an interface circuit configured to receive instruction information and display data from the outside; a selection circuit configured to select n pieces of selected duty ratio data, which are n pieces of duty ratio data of k pieces of duty ratio data, based on the instruction information; and a drive circuit configured to select output duty ratio data corresponding to a tone value indicated by the display data from the n pieces of selected duty ratio data, and performs PWM driving of the liquid crystal panel by outputting a drive signal having a duty ratio indicated by the selected output duty ratio data.

BRIEF DESCRIPTION OF THE DRAWINGS

The disclosure will be described with reference to the accompanying drawings, wherein like numbers reference like elements.

FIG. 11 shows a first example of instruction information to be received by an interface circuit.

FIG. 12 shows a second example of the instruction information to be received by the interface circuit.

FIG. 13 shows an example of a table to be stored in a storage unit.

FIG. 14 is a diagram illustrating display control using a temperature sensor.

DESCRIPTION OF EXEMPLARY EMBODIMENTS

Hereinafter, a preferable embodiment of the disclosure will be described in detail. Note that the embodiment given below is not intended to unduly limit the scope of the disclosure recited in the appended claims, and not all of the constituent elements described in the embodiment are essential to the disclosure.

1. Exemplary Configuration

Figure 1:
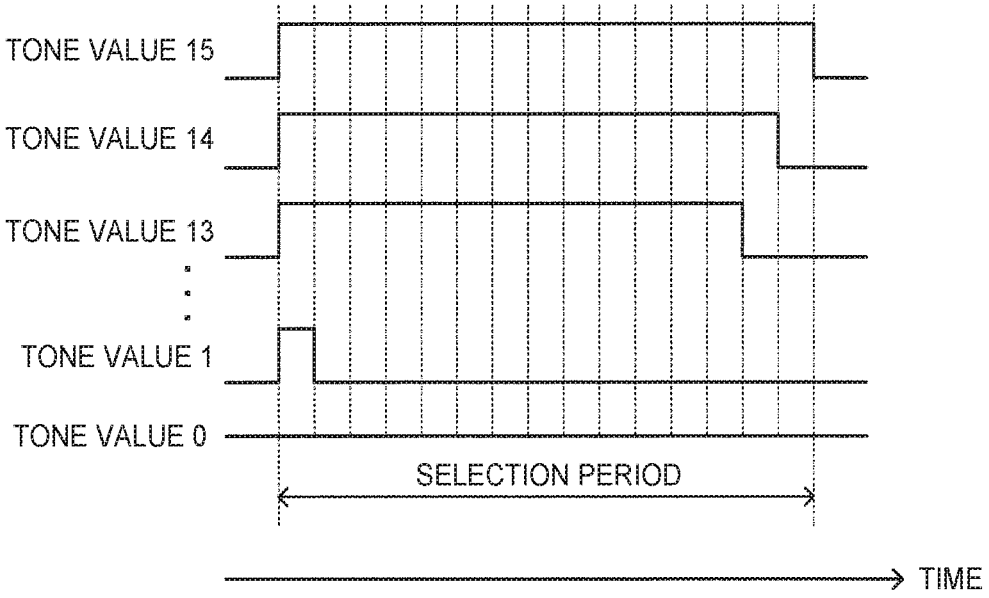
FIG. 1 shows exemplary waveforms of a drive signal when the duty ratios of PWM driving are set at equal intervals.
Figure 2:
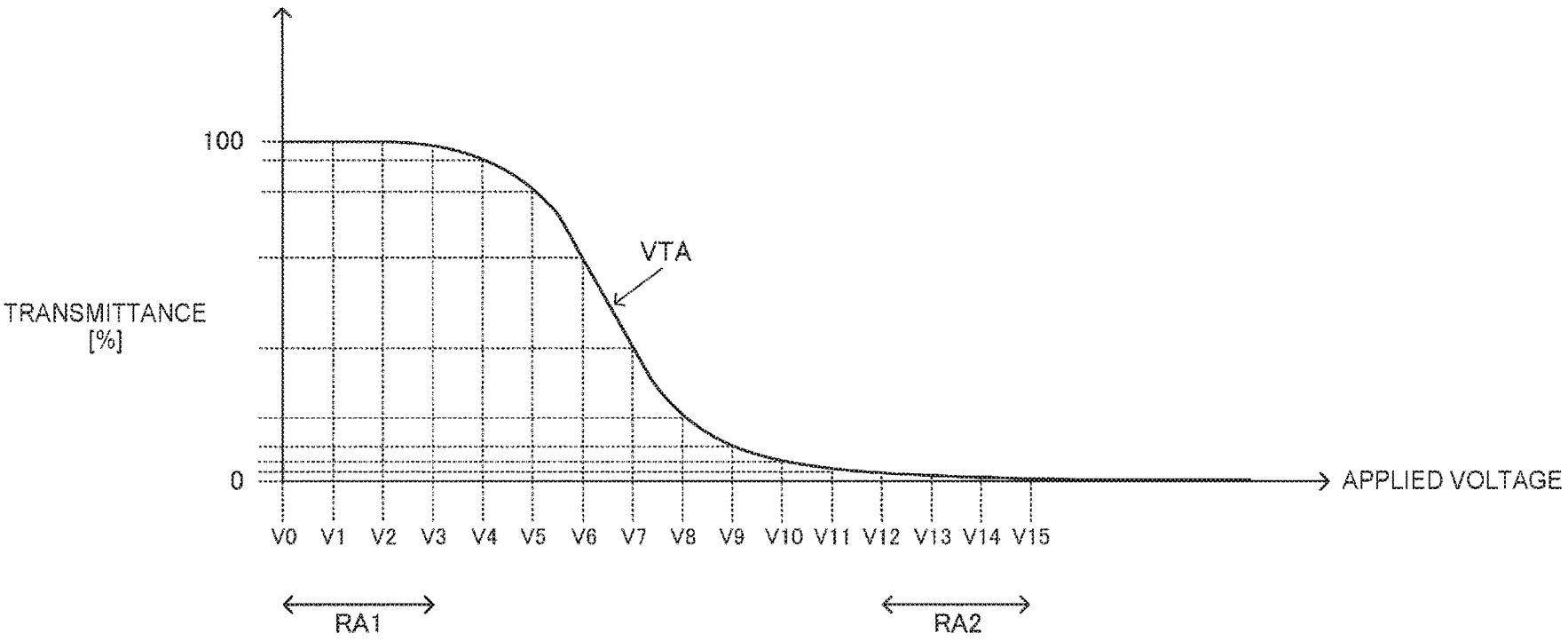
FIG. 2 shows a relationship between an effective voltage of the drive signal and transmittance of liquid crystal when the duty ratios of PWM driving are set at equal intervals.

The transmittance of liquid crystal when the duty ratio of PWM driving are set at equal intervals will be described using FIGS. 1 and 2. FIG. 1 shows exemplary waveforms of a drive signal, and FIG. 2 shows an exemplary characteristic illustrating the relationship between a voltage applied to liquid crystal and the transmittance of the liquid crystal. Note that, in the following, the relationship between the voltage applied to liquid crystal and the transmittance of the liquid crystal will be referred to as a VT characteristic.

FIG. 1 shows drive signals respectively corresponding to tone values 0 to 15. The drive signal is a signal for driving liquid crystal, that is, a signal having a potential difference between a segment signal and a common signal. Here, it is assumed that the liquid crystal is normally white, and the duty ratio of the drive signal is represented by a duty ratio at high (ratio of the period at a high level in one cycle). The drive signals corresponding to tone values 0, 1, . . . , 13, 14, and 15 respectively have duty ratios 0/15, 1/15, . . . , 13/15, 14/15, and 15/15. That is, in the example shown in FIG. 1, the duty ratios are set at equal intervals. Note that the case where the drive signal is at a high level for the entirety of a selection period is defined as a duty ratio 100%. The length of the selection period is an inverse of a frame frequency in PWM driving. The frame frequency is a rate at which the polarity is inverted in polarity inversion driving.

FIG. 2 shows a relationship between the effective voltages V0 to V15 of the drive signal and the transmittance of liquid crystal. When a drive signal, which is a PWM signal, is applied to liquid crystal, the effective voltage of the drive signal can be regarded as being applied to the liquid crystal. That is, the transmittance is determined based on the effective voltage of the drive signal. V0 to V15 denotes effective voltages of the drive signal corresponding to tone values 0 to 15. Since the duty ratios of the drive signal are set at equal intervals, the effective voltages V0 to V15 thereof are at equal intervals. However, the VT characteristic of liquid crystal does not change linearly with respect to the applied voltage, and therefore there is a problem in that the transmittance does not change at equal intervals with respect to the effective voltages V0 to V15 at equal intervals.

For example, in a range RA1 in which the applied voltage is low, the transmittance changes little in the vicinity of 100%, and in a range RA2 in which the applied voltage is high, the transmittance changes little in the vicinity of 0%. Therefore, the transmittance does not change in ranges of the tone values 0 to 3 and 12 to 15, and the tone values 0 to 3 and 12 to 15 are tone values that cannot be actually used. Also, because the VT characteristic does not linearly change at the tone values 3 to 12, which are intermediate tones, the transmittance does not change at equal intervals with respect to the tone values.

As described above, in the technique in JP-A-2006-243560, the problem described above is dealt with by setting the duty ratios of the drive signal in accordance with a specific VT characteristic. However, with the technique in JP-A-2006-243560, in order to deal with types of liquid crystal whose VT characteristics are different, display drivers need to be developed in accordance with the respective VT characteristics. In this way, liquid crystal drivers need to be developed for the respective types of liquid crystal whose VT characteristics are different in accordance with the respective VT characteristics, and there is a problem in that the development cost or the product cost increases.

Figure 3:
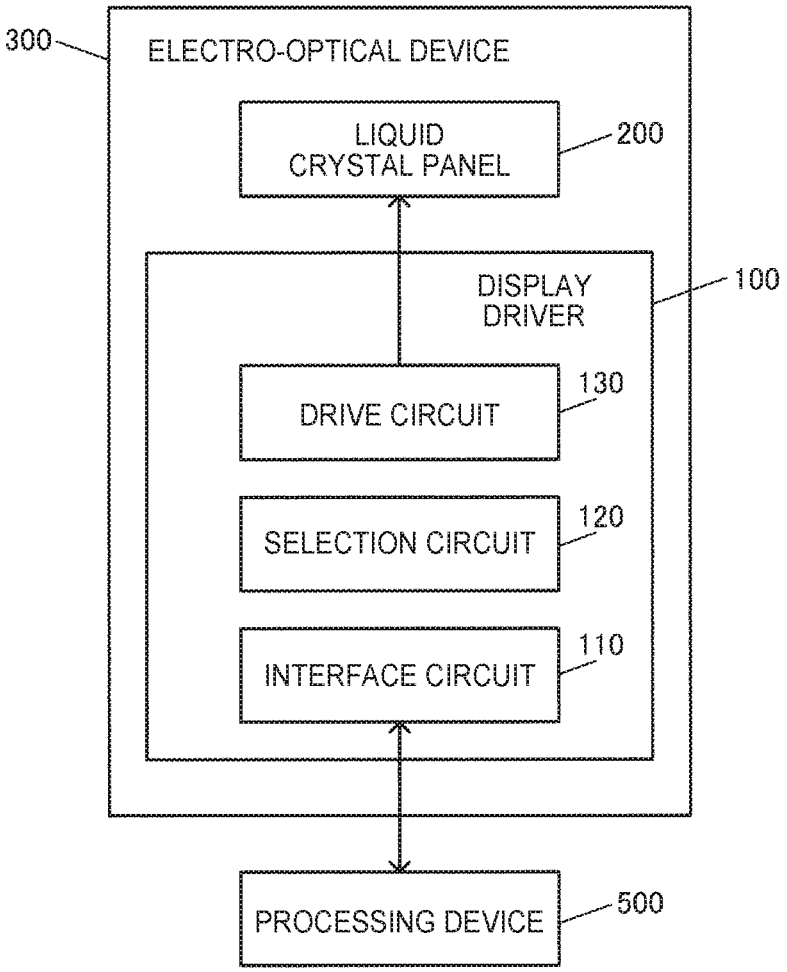
FIG. 3 shows a first exemplary configuration of a display driver, and an exemplary configuration of an electro-optical device.

FIG. 3 shows a first exemplary configuration of a display driver 100 of the present embodiment, and an exemplary configuration of an electro-optical device 300 including the display driver 100. The electro-optical device 300 includes a liquid crystal panel 200 and a display driver 100 that drives the liquid crystal panel 200.

The liquid crystal panel 200 adopts a static drive method. That is, the liquid crystal panel 200 includes a first glass substrate, a second glass substrate, and liquid crystal. The liquid crystal is enclosed between the first glass substrate and the second glass substrate. A segment electrode is provided in the first glass substrate, and a common electrode is provided in the second glass substrate. The display driver 100 outputs a segment drive signal to the segment electrode and a common drive signal to the common electrode. With this, a drive signal whose voltage is a potential difference between the segment drive signal and the common drive signal is applied to the liquid crystal between the segment electrode and the common electrode.

The display driver 100 is an integrated circuit (IC) device. The display driver 100 is an IC manufactured through a semiconductor process, and is a semiconductor chip in which circuit elements are formed on a semiconductor substrate. The display driver 100, which is an integrated circuit device, is mounted on a glass substrate of the liquid crystal panel 200. For example, the display driver 100 is mounted on the first glass substrate on which the segment electrode is provided. Alternatively, a configuration may be adopted in which the display driver 100 is mounted on a circuit substrate, and the circuit substrate and the liquid crystal panel 200 are coupled by a flexible substrate. The display driver 100 includes an interface circuit 110, a selection circuit 120, and a drive circuit 130.

The interface circuit 110 receives instruction information and display data from an external device. Specifically, the interface circuit 110 performs inter-circuit communication between a processing device 500 and the display driver 100. The processing device 500 transmits display data and instruction information, and the interface circuit 110 receives the display data and the instruction information. The display data is data indicating the tone to be displayed in a liquid crystal cell. For example, when display of 16 tones is possible, the range of tone value that can be indicated by the display data is from 0 to 15. The display data for one liquid crystal cell to perform tone display in one frame indicates one of tone values 0 to 15. In the following, the tone value indicated by the display data will be referred to as a tone value of the display data. The instruction information is information for instructing the correspondence relationship between the tone values in a tone value range that can be indicated by the display data and the duty ratios of the drive signal. For example, the interface circuit 110 is a serial interface circuit of an I2C (Inter Integrated Circuit) system, an SPI (Serial Peripheral Interface) system, or the like.

Note that the processing device 500 is a host device of the display driver 100, and is a processor or a display controller, for example. The processor is a CPU, a microcomputer, or the like. Note that the processing device 500 may be a circuit device that is constituted by a plurality of circuit components. For example, the processing device 500 may be an ECU (Electronic Control Unit) in an in-vehicle electronic apparatus.

The selection circuit 120 selects n pieces of duty ratio data from k pieces of duty ratio data based on the instruction information. The duty ratio data that has been selected is referred to as selected duty ratio data. n is an integer smaller than k, and corresponds to the number of tones that can be indicated by the display data. In the following, a case of k=75 and n=16 will be described as an example.

Figure 4:
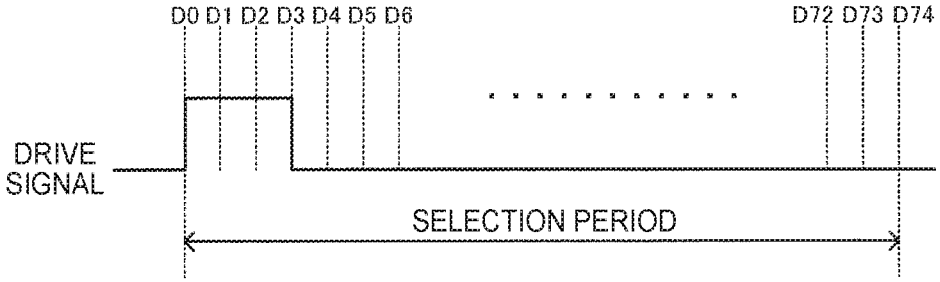
FIG. 4 is a diagram illustrating operations of a selection circuit.

FIG. 4 is a diagram illustrating operations of the selection circuit 120. Pieces of duty ratio data D0 to D74 correspond to 75 duty ratios that are different to each other. Specifically, the 75 pieces of duty ratio data D0 to D74 are pieces of data respectively indicating duty ratios of PWM driving at equal intervals. That is, the duty ratio data Di corresponds to a duty ratio i/74, where i is an integer of 0 or more and 74 or less.

The selection circuit 120 selects 16 pieces of selected duty ratio data by selecting one of the pieces of duty ratio data D0 to D74 for each of tone values 0 to 15. When FIG. 4 shows a drive signal corresponding to a tone value 1, FIG. 4 illustrates that duty ratio data D3 is selected for the tone value 1. Which of the pieces of duty ratio data D0 to D74 is selected for each tone value can be arbitrarily set by the instruction information.

Note that, in FIG. 4, the 75 pieces of duty ratio data D0 to D74 correspond to duty ratios at equal intervals, but there is no limitation thereto, and the intervals of duty ratios corresponding to the 75 pieces of duty ratio data D0 to D74 may not be equal.

The drive circuit 130 selects output duty ratio data corresponding to the tone value of the display data from the n pieces of selected duty ratio data, and drives the liquid crystal panel 200 by performing PWM driving at the duty ratio indicated by the selected output duty ratio data. For example, it is assumed that the tone value of the display data is 1 and the selected duty ratio data corresponding to the tone value 1 is D3. The duty ratio indicated by D3 is 3/74. In this case, the drive circuit 130 selects D3 corresponding to the tone value 1 as the output duty ratio data, and outputs the segment drive signal and the common drive signal such that the duty ratio of the drive signal is 3/74 based on the output duty ratio data D3.

According to the present embodiment, the interface circuit 110 receives instruction information from an external device, and the selection circuit 120 selects 16 pieces of selected duty ratio data from 75 pieces of duty ratio data based on the instruction information. In this way, as a result of using 75 pieces of duty ratio data larger than 16 pieces of duty ratio data, 16 pieces of duty ratio data corresponding to the 16 tones can be arbitrarily set. With this, the duty ratios of PWM driving that are suitable for the VT characteristic of any liquid crystal can be set. This point will be specifically described using FIGS. 5 to 7.

Figure 5:
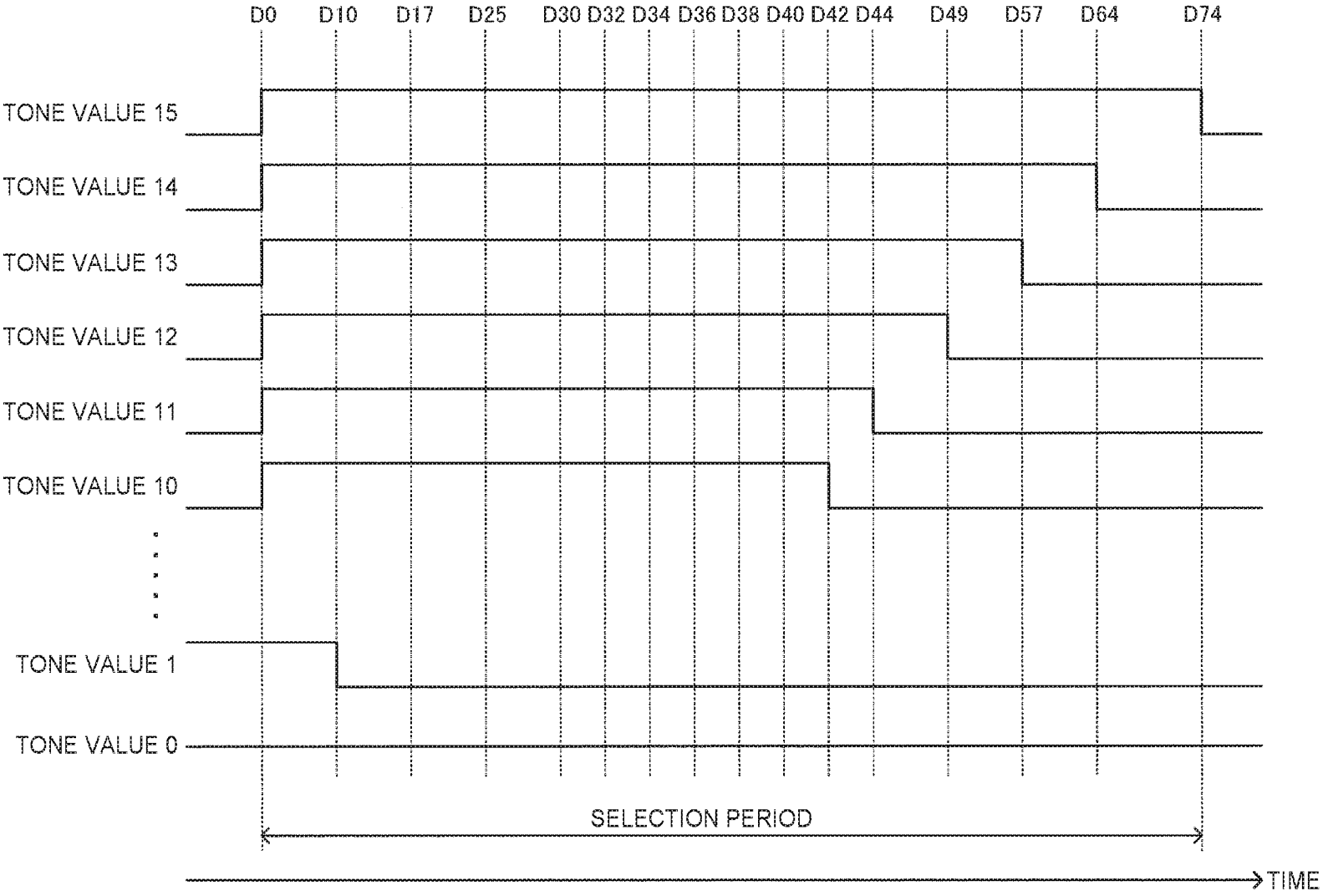
FIG. 5 shows an exemplary settings of selected duty ratio data.

FIG. 5 shows an exemplary settings of the selected duty ratio data. In the example shown in FIG. 5, duty ratios at unequal intervals are set with respect to tone values 0 to 15. As a result of selecting 16 pieces of selected duty ratio data from the 75 pieces of duty ratio data, such duty ratios at unequal intervals can be selected.

Figure 6:
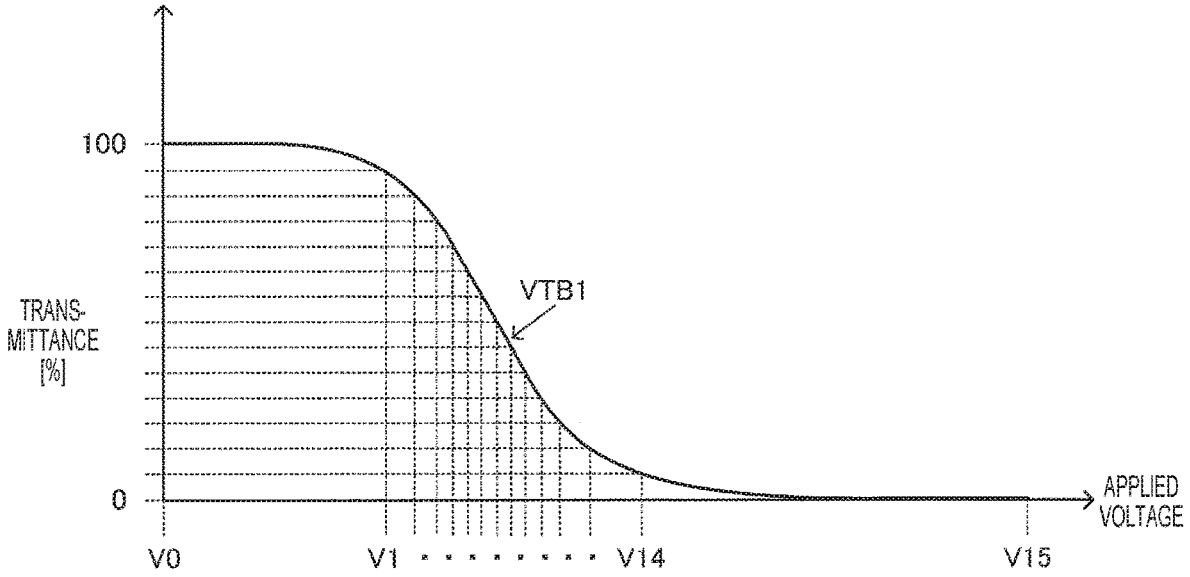
FIG. 6 shows a first example of the relationship between the effective voltage of the drive signal and the transmittance of liquid crystal.

FIG. 6 shows a first example of the relationship between effective voltages V0 to V15 of the drive signal and the transmittance of liquid crystal. Since the duty ratios of the drive signal are set at unequal intervals, the effective voltages V0 to V15 take values at unequal intervals. In a VT characteristic VTB1 of the target liquid crystal, the transmittance changes at equal intervals with respect to the effective voltages V0 to V15 at unequal intervals. That is, the 16 pieces of selected duty ratio data are selected such that the transmittance changes at equal intervals with respect to the tone values 0 to 15. As a result of selecting 16 pieces of selected duty ratio data from the 75 pieces of duty ratio data, such transmittance that changes at equal intervals can be realized.

Specifically, the 16 pieces of selected duty ratio data are set such that the intervals of duty ratios in a region in which the transmittance largely changes with respect to the change in applied voltage are smaller than the intervals of duty ratios in a region in which the transmittance changes little with respect to the change in applied voltage. As shown in FIG. 6, the region in which the transmittance largely changes is a region in which the slope of the VT characteristic VTB1 is large, and is a region close to the transmittance of 50%, for example. Also, the regions in which the transmittance changes little are regions in which the slope of the VT characteristic VTB1 is small, and are regions close to the transmittance of 100% and 0%, for example. As shown in FIGS. 5 and 6, the intervals of duty ratios in the vicinity of transmittance of 50% are smaller than the intervals of duty ratios in the vicinity of transmittance of 100% and 0%.

The VT characteristic of liquid crystal nonlinearly changes with respect to an applied voltage. According to the present embodiment, the intervals of duty ratios are set to be smaller, as the slope of transmittance increases, and therefore, the intervals of duty ratios can be realized such that the transmittance changes at equal interval in accordance with a nonlinear VT characteristic.

Figure 7:
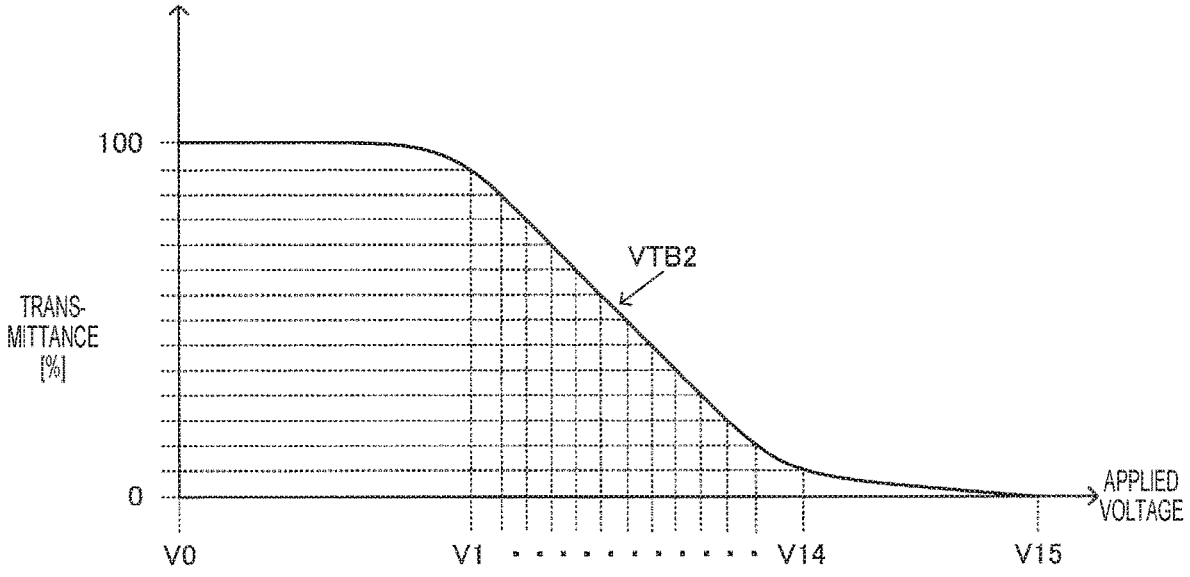
FIG. 7 shows a second example of the relationship between the effective voltage of the drive signal and the transmittance of liquid crystal.

FIG. 7 shows a second example of the relationship between effective voltages V0 to V15 and the transmittance of liquid crystal. The characteristic VTB2 is an example of a VT characteristic of a type of liquid crystal that is different from the type of liquid crystal that has the VT characteristic VTB1 shown in FIG. 6. In FIG. 7, the effective voltages V0 to V15 are set such that the transmittance changes at equal intervals in the VT characteristic VTB2, and 16 pieces of selected duty ratio data are set so as to realize the effective voltages V0 to V15. The 16 pieces of selected duty ratio data suitable for the VT characteristic VTB2 are different from the 16 pieces of selected duty ratio data suitable for the VT characteristic VTB1. As a result of selecting 16 pieces of selected duty ratio data from the 75 pieces of duty ratio data, such selected duty ratio data suitable for each type of liquid crystal can be selected. For example, 16 pieces of duty ratio data D0, D10, D17, D25, . . . , D36, D38, D40, D74 are selected from the pieces of duty ratio data D0 to D74 as selected duty ratio data 1 for realizing the effective voltages V0 to V15 for the liquid crystal having the VT characteristic VTB1 shown in FIG. 6, and 16 pieces of duty ratio data D0, D22, D28, D30, . . . , D50, D74 are selected from the pieces of duty ratio data D0 to D74 as selected duty ratio data 2 for realizing the effective voltages V0 to V15 for the liquid crystal having the VT characteristic VTB2 shown in FIG. 7.

2. Detailed Exemplary Configuration

Figure 8:
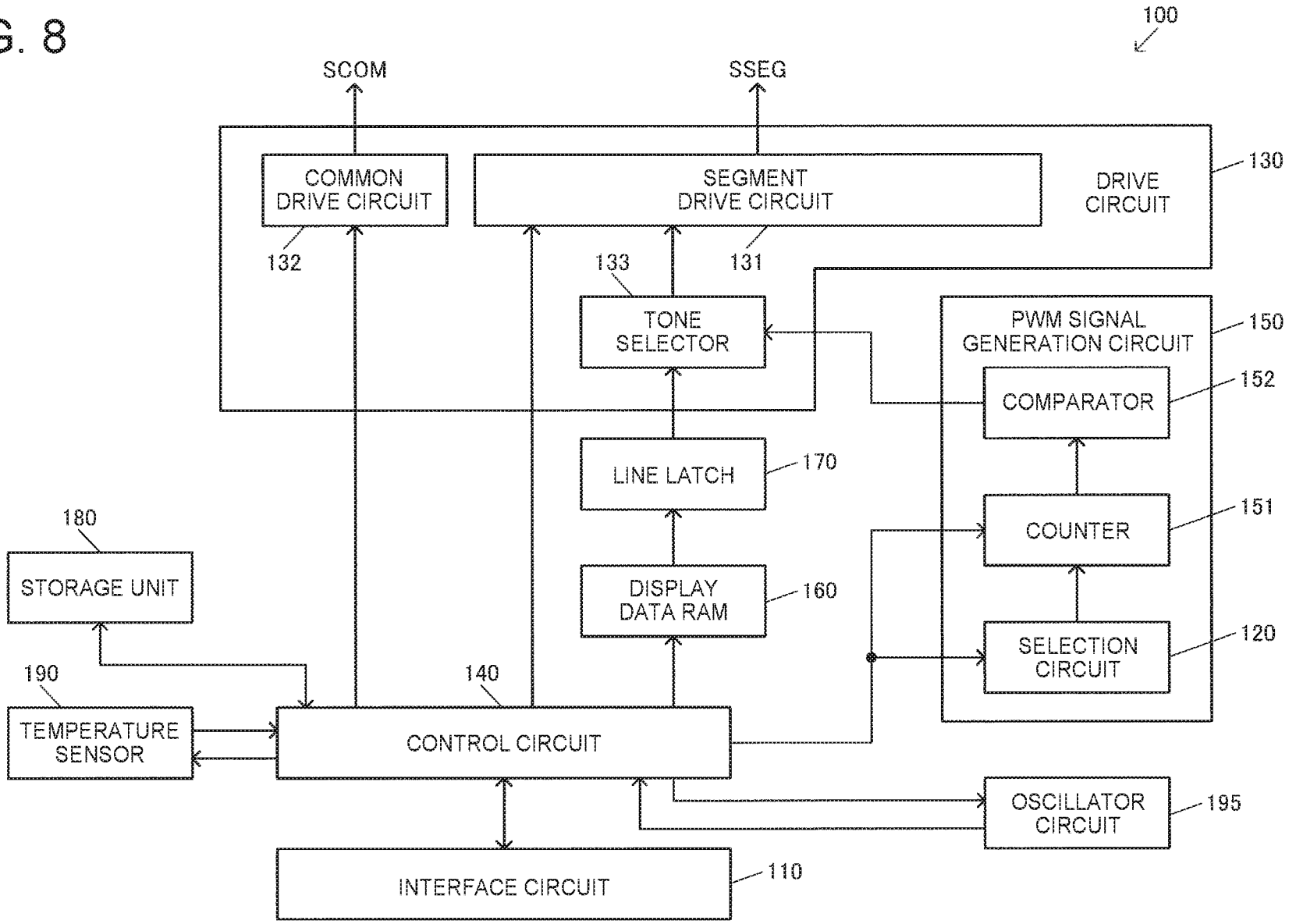
FIG. 8 shows a detailed exemplary configuration of the display driver.

FIG. 8 shows a detailed exemplary configuration of the display driver 100. The display driver 100 includes the interface circuit 110, the drive circuit 130, a control circuit 140, a PWM signal generation circuit 150, a display data RAM 160, a line latch 170, a storage unit 180, a temperature sensor 190, and an oscillator circuit 195. The constituent elements that are the same as the constituent elements that have been already described are given the same reference signs, and the description of the constituent elements will be appropriately omitted. Note that the configuration of the display driver 100 is not limited to the configuration shown in FIG. 5, and various modifications can be implemented such as omitting some of the constituent elements or adding other constituent elements. For example, the temperature sensor 190 may be omitted.

The oscillator circuit 195 generates a clock signal, and outputs the clock signal to the control circuit 140. The oscillator circuit 195 is an RC oscillator circuit, a ring oscillator, or a multivibrator, for example. Alternatively, the oscillator circuit 195 may be an oscillator circuit that causes a vibrator to oscillate.

The control circuit 140 is a logic circuit that operates based on the clock signal from the oscillator circuit 195. The control circuit 140 performs control of a display timing, an operation setting of the display driver 100, and the like. Specifically, the control circuit 140 writes the display data received by the interface circuit 110 to the display data RAM 160. Also, the control circuit 140 writes the setting data received by the interface circuit 110 to the storage unit 180. The setting data is information for instructing the frame frequency, instruction information for instructing the selected duty ratio data described above, and the like. Also, the control circuit 140 outputs a polarity inversion signal generated based on the clock signal to the drive circuit 130.

The storage unit 180 stores setting data for setting the operations of the display driver 100. The storage unit 180 is a register or a memory, for example. The memory may be a volatile memory such as SRAM or DRAM, or a nonvolatile memory such as EEPROM or a fuse memory.

The line latch 170 reads out display data that is to be displayed in one selection period from the display data RAM 160, and latches the read-out display data. It is assumed that the display driver 100 includes p segment drive outputs, where p is an integer of one or more. In this case, the line latch 170 latches p pieces of display data corresponding to the p segment drive outputs.

The PWM signal generation circuit 150 generates 16 PWM signals corresponding to 16 pieces of selected duty ratio data. The PWM signal generation circuit 150 includes the selection circuit 120, a counter 151, and a comparator 152.

The control circuit 140 reads out instruction information from the storage unit 180, and outputs the instruction information to the selection circuit 120. The selection circuit 120 selects 16 pieces of selected duty ratio data based on the instruction information.

The control circuit 140 outputs a clock signal for count operation to the counter 151 based on the clock signal. The counter 151 performs count operation based on the clock signal for count operation. Specifically, the clock signal for count operation has a frequency 75 times the frame frequency. The counter 151 is reset at the start of a selection period, and counts from 0 to 75 in the selection period.

In the configuration shown in FIG. 8, the selected duty ratio data is a count value corresponding to its duty ratio. The comparator 152 compares the count value of the counter 151 with the count value indicated by the selected duty ratio data. When the count value of the counter 151 matches the count value indicated by the selected duty ratio data, the comparator 152 inverts the logic level of the PWM signal. With this, a PWM signal having the duty ratio indicated by the selected duty ratio data is generated. This operation is performed with respect to each of the 16 pieces of selected duty ratio data, and as a result 16 PWM signals are generated.

As described above, in the present embodiment, the PWM signals are generated based on a clock signal whose frequency is higher than the frequency obtained by multiplying the frame frequency of PWM driving by 16, which is the number of tones. Specifically, the PWM signals are generated based on a clock signal whose frequency is 75 times the frame frequency in correspondence with the selectable 75 pieces of duty ratios. With this, any duty ratios can be selected from the 75 pieces of duty ratios as the duty ratios corresponding to the respective tone values, and therefore the duty ratios can be set in accordance with various VT characteristics of liquid crystal.

The drive circuit 130 drives the liquid crystal panel 200 based on the display data output from the line latch 170 and the PWM signal output from the PWM signal generation circuit 150. The drive circuit 130 includes a segment drive circuit 131, a common drive circuit 132, and atone selector 133. Note that, a case where the segment drive output has one output is illustrated in FIG. 8, but the segment drive output may have two or more outputs.

The tone selector 133 selects a PWM signal corresponding to the tone value of the display data output from the line latch 170 from the 16 PWM signals output from the PWM signal generation circuit 150.

The segment drive circuit 131 drives the segment electrode of the liquid crystal panel 200 by outputting a segment drive signal SSEG based on the PWM signal output from the tone selector 133. The segment drive circuit 131 outputs the segment drive signal SSEG by inverting the polarity of the PWM signal based on the polarity inversion signal, and buffering the polarity-inverted signal. For example, the segment drive circuit 131 is constituted by a logic circuit that performs processing for inverting the polarity of the PWM signal and a drive amplifier circuit that outputs the segment drive signal SSEG.

The common drive circuit 132 drives the common electrode of the liquid crystal panel 200 by outputting a common drive signal SCOM based on the polarity inversion signal. The polarity inversion signal is a signal indicating the polarity in a selection period, and a signal whose level changes between a high level and a low level for each selection period. The common drive circuit 132 outputs the common drive signal SCOM by buffering the polarity inversion signal. For example, the common drive circuit 132 is constituted by a drive amplifier circuit that outputs the common drive signal SCOM.

The temperature sensor 190 measures temperature, and output the temperature detection result to the control circuit 140. The temperature sensor 190 includes a sensor circuit that outputs a voltage based on the temperature as a temperature detection voltage, and an A/D converter circuit that A/D-converts the temperature detection voltage.

The sensor circuit outputs a voltage based on the temperature using the temperature dependency of the forward voltage in a PN junction. For example, the sensor circuit includes a bipolar transistor and a constant current circuit that causes a constant current to flow in the bipolar transistor, and outputs the temperature detection voltage based on the base-emitter voltage of the bipolar transistor. The A/D converter circuit output A/D-converted data of the temperature detection voltage to the control circuit 140 as the temperature detection result. Note that the display control using the temperature sensor 190 will be described later.

Figure 9:
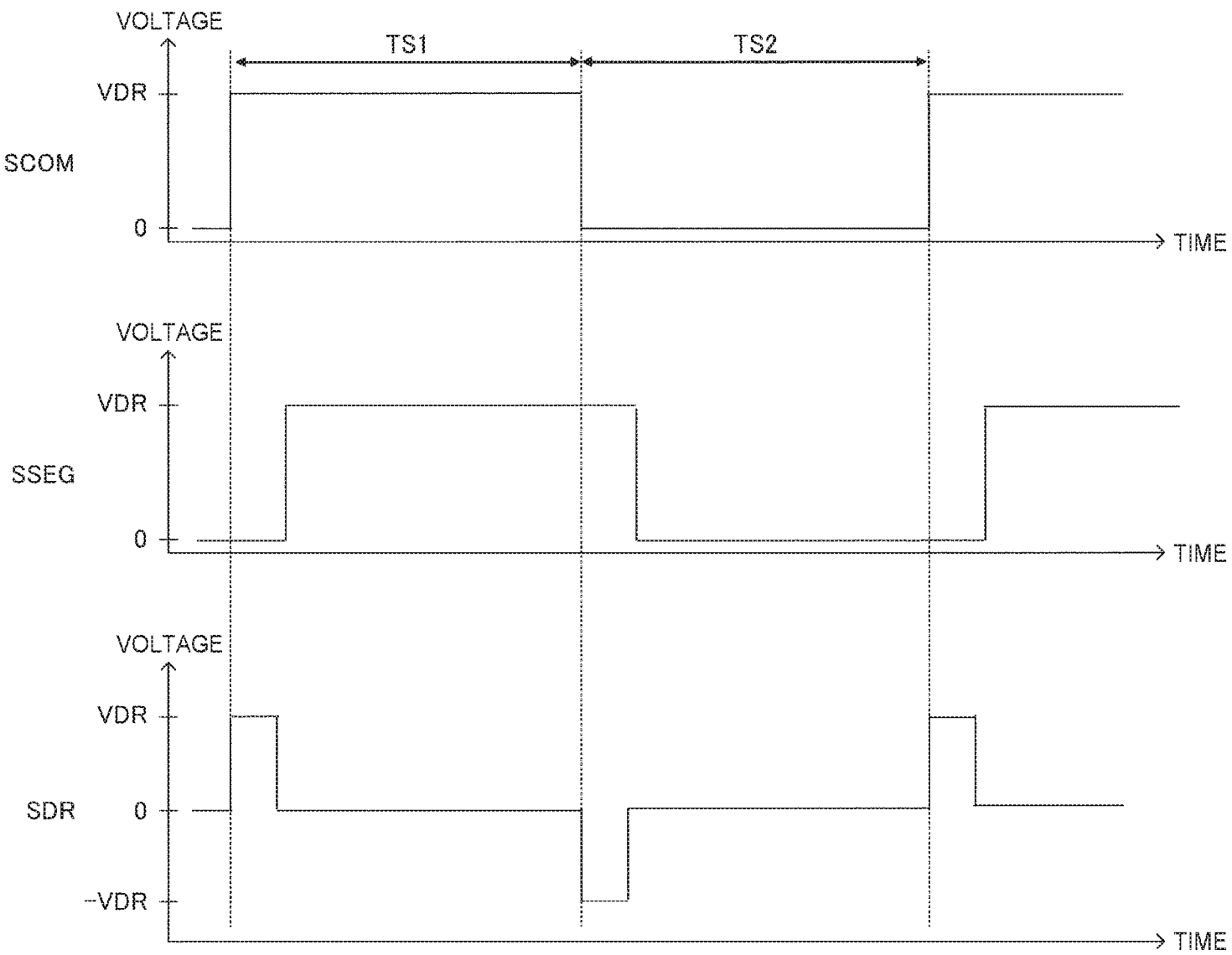
FIG. 9 shows exemplary waveforms of signals to be output from the display driver.

In the following, the detailed operations of the display driver 100 will be described. FIG. 9 shows exemplary waveforms of signals to be output from the display driver 100. TS1 denotes a selection period in which positive polarity driving is performed, and TS2 denotes a selection period in which negative polarity driving is performed. In the following, the period TS1 is referred to as a positive polarity selection period, and the period TS2 is referred to as a negative polarity selection period.

In the positive polarity selection period TS1, the common drive circuit 132 outputs the common drive signal SCOM at a voltage VDR, and the segment drive circuit 131 outputs the segment drive signal SSEG that transitions from 0 V to the voltage VDR. The timing at which the segment drive signal SSEG transitions is determined by the tone value of the display data. That is, the duty ratio at 0 V in the segment drive signal SSEG is the duty ratio corresponding to the tone value of the display data. The voltage of a drive signal SDR is a potential difference between the common drive signal SCOM and the segment drive signal SSEG. In the drive signal SDR, the duty ratio at the voltage VDR is the duty ratio corresponding to the tone value of the display data.

In the negative polarity selection period TS2, the common drive circuit 132 outputs the common drive signal SCOM at 0 V, and the segment drive circuit 131 outputs the segment drive signal SSEG that transitions from the voltage VDR to 0 V. In the segment drive signal SSEG, the duty ratio at voltage VDR is the duty ratio corresponding to the tone value of the display data. With this, in the drive signal SDR, the duty ratio at voltage −VDR is the duty ratio corresponding to the tone value of the display data.

Figure 10:
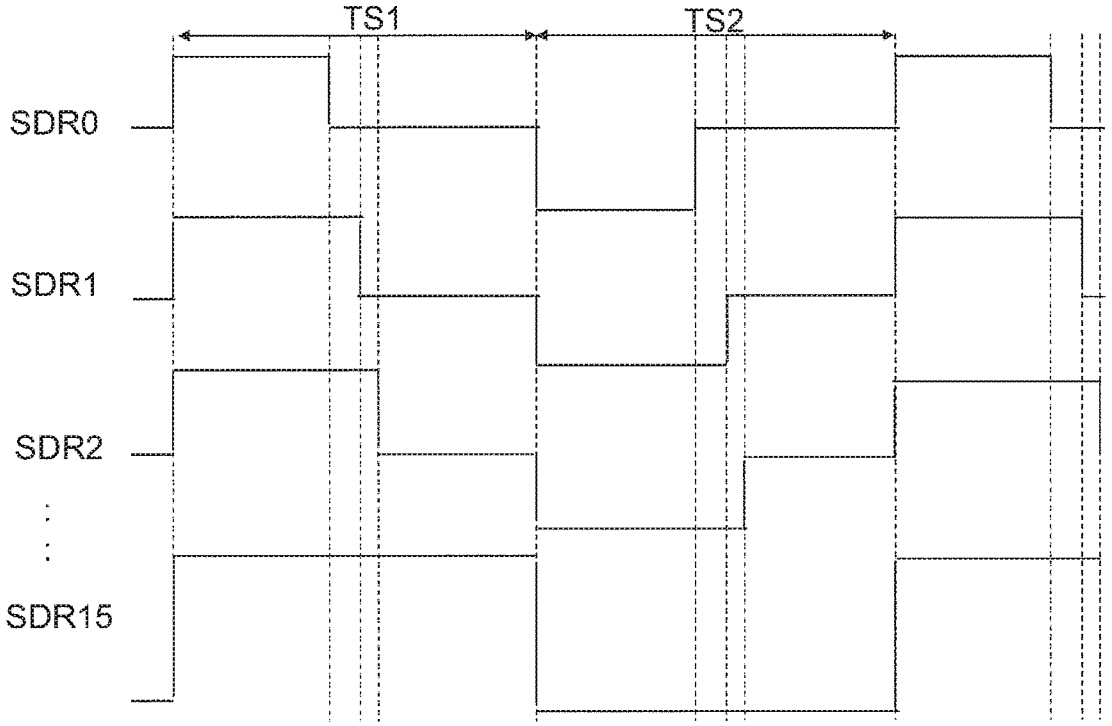
FIG. 10 shows exemplary waveforms of the drive signal with respect to respective tone values.

FIG. 10 shows exemplary waveforms of the drive signal SDR with respect to respective tone values. SDR0 denotes the drive signal when the tone value of the display data is 0. Similarly, SDR1 to SDR15 respectively denote the drive signals when the tone value of the display data is 1 to 15. The duty ratios of SDR0 to SDR15 are determined by the 16 pieces of selected duty ratio data that the selection circuit 120 has selected from the 75 pieces of duty ratio data.

FIG. 11 shows a first example of the instruction information to be received by the interface circuit 110. The tone values 0 to 15 are described by binary numbers. The instruction information shown in FIG. 11 is information in which duty ratio data is associated with each of tone values 0000 to 1111.

The processing device 500 transmits the pieces of duty ratio data associated with the respective tone values to the interface circuit 110 along with a command for setting the duty ratios. The interface circuit 110 writes the duty ratio data received along with the command into the storage unit 180. With this, a table in which the pieces of duty ratio data are associated with the respective tone values 0000 to 1111 is written into the storage unit 180. The selection circuit 120 selects the 16 pieces of selected duty ratio data by reading out the table from the storage unit 180.

FIG. 12 shows a second example of the instruction information to be received by the interface circuit 110. The instruction information shown in FIG. 12 is information in which models A and B of the liquid crystal panel 200 are respectively assigned with model numbers 00 and 01. Alternatively, the instruction information may also be information in which the type of liquid crystal is assigned with a number.

FIG. 13 shows an example of a table to be stored in the storage unit 180. In the table shown in FIG. 13, a first table is associated with the model number 00, and a second table is associated with the model number 01. Each table is a table in which duty ratio data is associated with each of tone values 0000 to 1111. These tables are determined such that suitable duty ratios are set for each model of the liquid crystal panel 200. The tables shown in FIG. 13 are written into the storage unit 180 in advance when the display driver 100 or the electro-optical device 300 is manufactured.

The processing device 500 transmits the model number to the interface circuit 110 along with a command for setting the model of the liquid crystal panel 200. The interface circuit 110 writes the model number received along with the command into the storage unit 180. The selection circuit 120 selects 16 pieces of selected duty ratio data by reading out the model number from the storage unit 180, and reading out the table associated with the model number.

According to the second example described above, the selection circuit 120 selects 16 pieces of duty ratio data by selecting, from a first duty ratio data set and a second duty ratio data set, a duty ratio data set corresponding to the instruction information. The selection circuit 120 selects the first duty ratio data set when the instruction information is information for instructing driving of a first liquid crystal panel, and selects the second duty ratio data set when the instruction information is information for instructing driving of a second liquid crystal panel. The first duty ratio data set is constituted by a first group of 16 pieces of duty ratio data, and the second duty ratio data set is constituted by a second group of 16 pieces of duty ratio data. In the table shown in FIG. 13, the first duty ratio data set corresponds to the first table of the model number 00, and the second duty ratio data set corresponds to the second table of the model number 01.

In this way, the duty ratio data set suitable for the liquid crystal panel 200 that has been combined with the display driver 100 can be selected from a plurality of duty ratio data sets that have been prepared in advance. The model or the like of the liquid crystal panel 200 need only be designated as the instruction information, and as a result, the processing performed when the processing device 500 instructs duty ratios to the display driver 100 can be simplified.

FIG. 14 is a diagram illustrating display control using the temperature sensor 190. As shown in FIG. 14, the drive circuit 130 performs PWM driving at a frame frequency that changes based on the temperature detection result of the temperature sensor 190.

Specifically, the temperature sensor 190 outputs the temperature detection data to the control circuit 140. When the temperature detection data indicates temperatures T1 to T16, the control circuit 140 respectively sets the frame frequency to f1 to f16. Note that, in the table shown in FIG. 14, the number of steps of the frame frequency is 16, but there is no limitation thereto. The control circuit 140 generates the polarity inversion signal by frequency-dividing the clock signal from the oscillator circuit 195, for example. The control circuit 140 sets the frequency of the polarity inversion signal, that is, the frame frequency, by setting the frequency-dividing ratio based on the temperature detection data.

As the temperature of liquid crystal increases, the drive voltage at which optimum contrast can be obtained (hereinafter, drive voltage) decreases. Also, if it is assumed that the duty ratio and the frame frequency of the drive signal to be output from the display driver 100 do not change, the effective voltage to be applied to liquid crystal does not change. Therefore, as the temperature of liquid crystal increases, the effective voltage increases so as to be relatively higher than the drive voltage of the liquid crystal. Therefore, if the effective voltage does not change, as the temperature of liquid crystal increases, the optimum contrast of the liquid crystal cannot be obtained. In the present embodiment, if it is assumed that T1<T2< . . . <T16, f1<f2< . . . <f16. That is, as the temperature of liquid crystal increases, the frame frequency increases. Assume that the duty ratio of the drive signal to be output from the display driver 100 does not change, as the frame frequency increases, the effective voltage to be applied to the liquid crystal decreases. Therefore, even if the drive voltage of the liquid crystal decreases due to temperature increase, as a result of reducing the effective voltage by increasing the frame frequency, adjustment can be made such that the optimum contrast of the liquid crystal can be obtained.

3. Electronic Apparatus and Mobile Body

Figure 15:
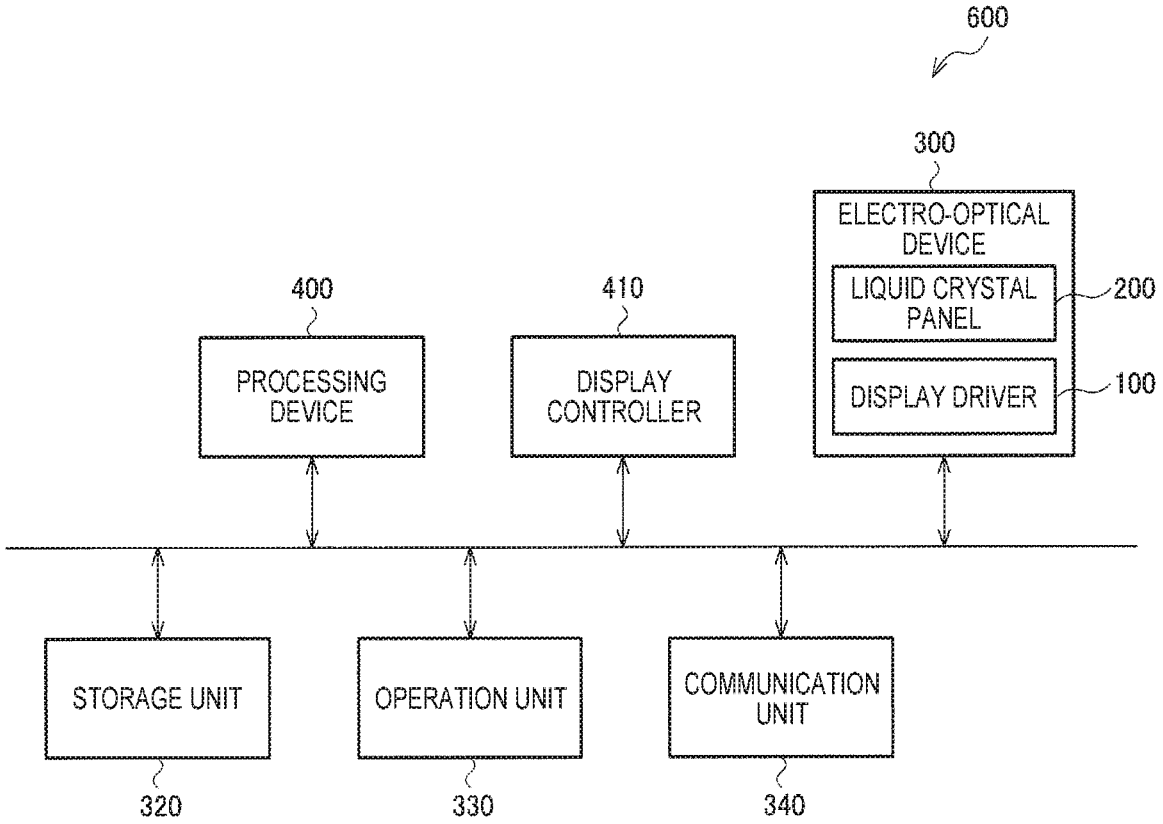
FIG. 15 shows an exemplary configuration of an electronic apparatus.

FIG. 15 shows an exemplary configuration of an electronic apparatus 600 including the display driver 100 of the present embodiment. Various electronic apparatuses incorporating an electro-optical device can be envisioned as the electronic apparatus of the present embodiment. For example, an in-vehicle device, a display, a projector, a television device, an information processing device, a mobile information terminal, a car navigation system, a mobile game terminal, a DLP (Digital Light Processing) device, or the like can be envisioned as the electronic apparatus of the present embodiment. The in-vehicle device is an in-vehicle display device such as a cluster panel, for example. The cluster panel is provided in front of a driver's seat, and is a display panel that displays a meter and the like.

The electronic apparatus 600 includes a processing device 400, a display controller 410, an electro-optical device 300, a storage unit 320, an operation unit 330, and a communication unit 340. The electro-optical device 300 includes the display driver 100 and the liquid crystal panel 200.

The operation unit 330 is a user interface for receiving various operations made by a user. The operation unit 330 is constituted by a button, a mouse, a keyboard, and a touch panel, for example. The communication unit 340 is a data interface for performing communication of display data and control data. The communication unit 340 is a wired communication interface such as a USB or a wireless communication interface such as a wireless LAN, for example. The storage unit 320 stores image data input from the communication unit 340. Alternatively, the storage unit 320 functions as a working memory of the processing device 400. The storage unit 320 is a semiconductor memory, a hard disk drive, an optical drive, or the like. The processing device 400 performs processing to control the units of the electronic apparatus, and various types of data processing. The processing device 400 transfers display data received by the communication unit 340 or display data stored in the storage unit 320 to the display controller 410. The processing device 400 is a processor such as a CPU. The display controller 410 converts the format of the received display data to a format that the electro-optical device 300 can accept, and outputs the converted display data to the display driver 100. The display driver 100 drives the liquid crystal panel 200 based on the display data transferred from the display controller 410.

Figure 16:
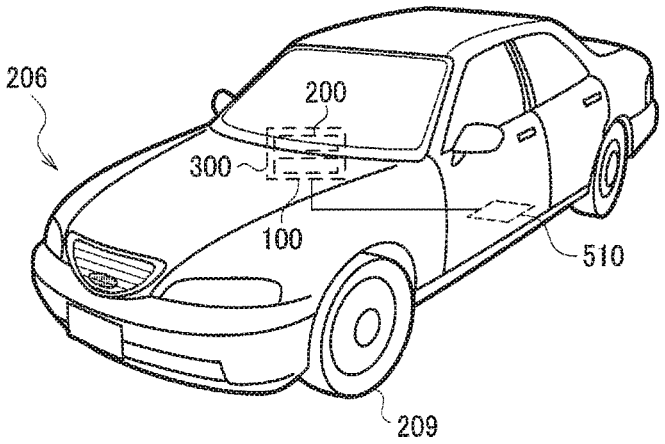
FIG. 16 shows an example of a mobile body.

FIG. 16 shows an exemplary configuration of a mobile body including the display driver 100 of the present embodiment. The mobile body is an apparatus or device that includes a drive mechanism such as an engine or a motor, steering mechanisms such as a steering wheel or a rudder, and various electronic apparatus, for example, and moves on the ground, in the air, and on the sea. Various types of mobile bodies such as a car, an airplane, a motorcycle, a ship, a mobile robot, and a walking robot can be envisioned as the mobile body of the present embodiment, for example.

FIG. 16 schematically illustrates an automobile 206 serving as a specific example of the mobile body. The electro-optical device 300 and a control device 510 that controls the units of the automobile 206 are incorporated in the automobile 206. The electro-optical device 300 includes the display driver 100 and the liquid crystal panel 200. The control device 510 creates display image for displaying pieces of information such as speed, remaining fuel amount, travel distance, and settings of various types of devices to a user, and transmits the display data to the display driver 100. The display driver 100 drives the liquid crystal panel 200 based on the display data. With this, information is displayed in the liquid crystal panel 200.

The display driver described above drives a liquid crystal panel that is driven by a static drive method. The display driver includes an interface circuit, a selection circuit, and a drive circuit. The interface circuit receives instruction information and display data from the outside. The selection circuit selects n pieces of selected duty ratio data, which are n pieces of duty ratio data of k pieces of duty ratio data, based on the instruction information. The drive circuit selects output duty ratio data corresponding to a tone value of the display data from the n pieces of selected duty ratio data, and performs PWM driving of the liquid crystal panel by outputting a drive signal having a duty ratio indicated by the selected output duty ratio data.

According to the present embodiment, as a result of using k pieces of duty ratio data that are larger than n pieces of duty ratio data, n pieces of duty ratio data corresponding to n tones can be arbitrarily set. With this, the duty ratio of PWM driving suitable for the VT characteristic of any liquid crystal can be set. That is, the display driver can be combined with various liquid crystal panels without re-designing the display driver.

Also, in the present embodiment, the n pieces of selected duty ratio data may be pieces of data that are set such that the interval of duty ratios in a region in which the change in transmittance of the liquid crystal panel relative to the change in effective voltage of the drive signal is large is smaller than the interval of duty ratios in a region in which the change in transmittance of the liquid crystal panel relative to the change in effective voltage of the drive signal is small.

Liquid crystal has a VT characteristic in which the transmittance changes non-linearly relative to the applied voltage. According to the present embodiment, the interval of duty ratios is set to be smaller as the slope of the transmittance increases, and therefore the intervals of duty ratios can be realized such that the transmittance is set at equal intervals in accordance with a non-linear VT characteristic.

Also, in the present embodiment, the selection circuit may select the n pieces of selected duty ratio data by selecting a duty ratio data set corresponding to the instruction information from a first duty ratio data set that is constituted by a first group of n pieces of duty ratio data and a second duty ratio data set that is constituted by a second group of n pieces of duty ratio data that is different from the first group.

According to the present embodiment, a duty ratio data set suitable for the liquid crystal panel that has been combined with the display driver can be selected from the first duty ratio data set and the second duty ratio data set that have been prepared in advance.

Also, in the present embodiment, the selection circuit may select the first duty ratio data set when the instruction information is information for instructing driving of a first liquid crystal panel, and select the second duty ratio data set when the instruction information is information for instructing driving of a second liquid crystal panel.

According to the present embodiment, the duty ratio data set can be designated by merely designating a model or the like of the liquid crystal panel as the instruction information, and therefore the processing that is performed when the duty ratio is instructed to the display driver from an external device can be simplified.

Also, in the present embodiment, the drive circuit may perform the PWM driving based on a clock signal whose frequency is higher than the frequency obtained by multiplying the frame frequency of the PWM driving by n.

With this, the selection period corresponding to one cycle of the PWM waveform can be divided into periods whose number is larger than n. With this, k duty ratios corresponding to k pieces of duty ratio data larger than n pieces of duty ratio data can be realized. For example, when a clock signal whose frequency is k times the frame frequency is used, the selection period is divided into k periods. k duty ratios can be realized by k divided periods.

Also, in the present embodiment, the k pieces of duty ratio data may be pieces of data respectively indicating duty ratios of the PWM driving at equal intervals.

According to the present embodiment, the selection period need only be divided into k periods using a clock signal whose frequency is k times the frame frequency, and therefore the k duty ratios can be realized by a simple configuration. For example, a clock signal whose frequency is higher than the frequency k times the frame frequency need not be prepared.

Also, in the present embodiment, the drive circuit may drive a segment electrode of the liquid crystal panel.

According to the present embodiment, as a result of the drive circuit outputting a signal having a PWM waveform to the segment electrode, the liquid crystal that is interposed between the segment electrode and a common electrode can be PWM-driven. That is, the common electrode need only be driven by a polarity inversion signal, and therefore the driving of the common electrode can be simplified. The drive signal having a PWM waveform can be realized by utilizing the potential difference between the common drive signal, which is a polarity inversion signal, and a segment drive signal having a PWM waveform.

Also, in the present embodiment, the display driver may include a temperature sensor. The drive circuit may perform the PWM driving at a frame frequency that changes based on a temperature detection result of the temperature sensor.

According to the present embodiment, the increase in effective voltage of the drive signal due to the increase in temperature can be reduced by the decrease in effective voltage of the drive signal by increasing the frame frequency. With this, the change in tone due to the change in temperature can be suppressed.

Also, the electro-optical device of the present embodiment may include any of the display drivers described above and the liquid crystal panel.

Also, the electronic apparatus of the present embodiment includes any of the display drivers described above.

Also, the mobile body of the present embodiment includes any of the display drivers described above.

Note that although an embodiment has been described in detail above, a person skilled in the art will readily appreciate that it is possible to implement numerous variations and modifications that do not depart substantially from the novel aspects and effect of the disclosure. Accordingly, all such variations and modifications are also to be included within the scope of the disclosure. For example, terms that are used within the description or drawings at least once together with broader terms or alternative synonymous terms can be replaced by those other terms at other locations as well within the description or drawings. Also, all combinations of the embodiment and variations are also encompassed in the range of the disclosure. Moreover, the configuration and operation of the display driver, the liquid crystal panel, the electro-optical device, the electronic apparatus, the mobile body, and the like are not limited to those described in the present embodiment, and various modifications are possible.

What is claimed is:

1. A display driver that drives a liquid crystal panel that is driven by a static drive method, the display driver comprising:

an interface circuit configured to receive instruction information and display data from outside;

a selection circuit configured to select n pieces of selected duty ratio data, which are n pieces of duty ratio data of k pieces of duty ratio data (n is an integer smaller than k), based on the instruction information; and a drive circuit configured to select output duty ratio data corresponding to a tone value indicated by the display data from the n pieces of selected duty ratio data, and performs PWM driving of the liquid crystal panel by outputting a drive signal having a duty ratio indicated by the selected output duty ratio data.

2. The display driver according to claim 1, wherein the n pieces of selected duty ratio data are pieces of data that are set such that the interval of duty ratios in a region in which the change in transmittance of the liquid crystal panel relative to the change in effective voltage of the drive signal is large is smaller than the interval of duty ratios in a region in which the change in transmittance of the liquid crystal panel relative to the change in effective voltage of the drive signal is small.

3. The display driver according to claim 1, wherein the selection circuit is configured to select the n pieces of selected duty ratio data by selecting a duty ratio data set corresponding to the instruction information from a first duty ratio data set that is constituted by a first group of n pieces of duty ratio data and a second duty ratio data set that is constituted by a second group of n pieces of duty ratio data that is different from the first group.

4. The display driver according to claim 3, wherein the selection circuit is configured to select the first duty ratio data set when the instruction information is information for instructing driving of a first liquid crystal panel, and select the second duty ratio data set when the instruction information is information for instructing driving of a second liquid crystal panel.

5. The display driver according to claim 1, wherein the drive circuit is configured to perform the PWM driving based on a clock signal whose frequency is higher than the frequency obtained by multiplying the frame frequency of the PWM driving by n.

6. The display driver according to claim 1, wherein the k pieces of duty ratio data are pieces of data respectively indicating duty ratios of the PWM driving at equal intervals.

7. The display driver according to claim 1, wherein the drive circuit is configured to drive a segment electrode of the liquid crystal panel.

8. The display driver according to claim 1, further comprising a temperature sensor, wherein the drive circuit is configured to perform the PWM driving at a frame frequency that changes based on a temperature detection result of the temperature sensor.

9. An electro-optical device comprising:

the display driver according to claim 1; and the liquid crystal panel.

10. An electronic apparatus comprising the display driver according to claim 1.

11. A mobile body comprising the display driver according to claim 1.

* * * * *